US011697479B2

(12) United States Patent
Huang

(10) Patent No.: US 11,697,479 B2
(45) Date of Patent: Jul. 11, 2023

(54) RESCUE METHOD AND SYSTEM FOR MAN OVERBOARD WITH REMOTE MONITORING

(71) Applicant: SHIP AND OCEAN INDUSTRIES R&D CENTER, New Taipei (TW)

(72) Inventor: Chun-Chia Huang, New Taipei (TW)

(73) Assignee: SHIP AND OCEAN INDUSTRIES R&D CENTER, New Taipei (TW)

( * ) Notice: Subject to any disclaimer, the term of this patent is extended or adjusted under 35 U.S.C. 154(b) by 0 days.

(21) Appl. No.: 17/549,562

(22) Filed: Dec. 13, 2021

(65) Prior Publication Data

US 2023/0174205 A1 Jun. 8, 2023

(30) Foreign Application Priority Data

Dec. 8, 2021 (TW) ..... 110145905

(51) Int. Cl.
*B63C 9/00* (2006.01)

(52) U.S. Cl.
CPC .... *B63C 9/0005* (2013.01); *B63C 2009/0017* (2013.01)

(58) Field of Classification Search
CPC ..... B63C 9/0005
See application file for complete search history.

(56) References Cited

U.S. PATENT DOCUMENTS

| | | | | |
|---|---|---|---|---|
| 5,886,635 | A | 3/1999 | Landa et al. | |
| 8,998,666 | B1 * | 4/2015 | Albright | B63C 9/20 340/573.6 |
| 10,377,455 | B2 * | 8/2019 | Oh | B63C 9/22 |

FOREIGN PATENT DOCUMENTS

| | | |
|---|---|---|
| CN | 203941601 U | 11/2014 |
| CN | 208922446 U | 5/2019 |
| CN | 209112417 U | 7/2019 |

* cited by examiner

*Primary Examiner* — Benyam Haile
(74) *Attorney, Agent, or Firm* — Cheng-Ju Chiang

(57) ABSTRACT

The present invention proposes a rescue system and method for man overboard with remote monitoring, which is implemented by a rescue system consisted of an onboard processing unit, a distress signal module, an unmanned rescue vehicle, an autonomous ship, a communication module, and a shore control center (SCC). The technical effect of the present invention is that when a person falls into the water, the unmanned rescue vehicle can automatically locate and monitor the falling target immediately, and the shore control center (SCC) can accurately locate the relative position between the unmanned rescue vehicle and the ship where the person falls. Thereby, the shore control center (SCC) can control the rescue process throughout the entire process and release rescue device for rescue.

3 Claims, 3 Drawing Sheets

RESCUE METHOD AND SYSTEM FOR MAN OVERBOARD WITH REMOTE MONITORING

TECHNICAL FIELD

The present invention relates to a kind of rescue method and system for man overboard, especially a rescue method for man overboard applied to the crew member of a marine vehicle with remote monitoring. The self-propelled unmanned rescue vehicle can automatically and actively navigate to a falling object and accurately locate the relative position between the unmanned rescue vehicle and the mother ship where the individual overboard is from. In this regard, the shore control center (SCC) identifies the location of the man overboard and takes over the ship at the first time.

BACKGROUND OF RELATED ARTS

In recent years, countries around the world have continued to carry out large-scale projects related to autonomous vessels. Autonomous or semi-autonomous driverless ships or ships with low manning have been the mainstream development. For example, in the past four years, autonomous vessels with sensing, decision-making, and collision avoidance functions have been widely proposed and applied to various types of ships. Although there remains no international commercial operations of autonomous vessels, which may result from the restriction of international laws and regulations, many countries have completed the trial operation of autonomous vessels, including passenger ferries or cargo ships in Norway and Finland, passenger ships or tugboats in the Netherlands, tugboats in Singapore, large-scale transport ships or sightseeing ships in Japan, and inland water transport vessels in Belgium and sightseeing river boats in Taiwan.

The currently known technology mainly focuses on three themes, which are classified into "methods for monitoring man overboard", "methods for rescue using unmanned vehicles" and "devices for rescue by unmanned vehicles". In view of the previous three classifications, the second classification mostly aims at what method is used to rescue, or how to dispatch an autonomous ship or an unmanned aircraft for search and rescue after people falling into the water. However, it remains no existing rescue system that integrates with the control system of the autonomous vessels.

Therefore, if the autonomous or semi-autonomous driverless ships or low manning ships keep developing in the future, there is an urgent necessity to develop another comprehensive set of standard rescue device to cope with various distress situations, regarding how to integrate the control center remotely controlling the autonomous ships for rescue under the condition that there is none or only low-manning on the unmanned ships.

SUMMARY

In order to solve the problem of the prior arts, the object of the present invention is to provide a rescue method and system for man overboard with remote monitoring. The present invention enables the shore control center (SCC) of the autonomous or semi-autonomous driverless ships or low manning ships to immediately rescue the individual which has fallen overboard therefrom, if not, the people in distress from other's ships.

The present invention provides a rescue system for man overboard with remote monitoring, comprising: an onboard processing unit disposed on a marine vessel, a communication module, a distress signal module wirelessly connected with the onboard processing unit via the communication module, an unmanned rescue vehicle wirelessly connected with the onboard processing unit via the communication module, a collection module disposed on the marine vehicle, the unmanned rescue vehicle or a combination thereof, and a control center wirelessly connected with the onboard processing unit as well as the collection module via the communication module.

The present invention further provides a rescue method for man overboard with remote monitoring, implemented by the rescue system for man overboard with remote monitoring as previously mentioned, wherein the rescue method comprises: (A) Remote monitoring images received by a control center, along with at least one distress signal collected by a distress signal module, are transmitted to an onboard processing unit via a communication module. (B) Classifications based on the at least one distress signal are given by the onboard processing unit. (C) According to the classifications, the at least one distress signal comprises an intrinsic man overboard positioning information, an external man overboard positioning information or a combination thereof. In the event that the intrinsic man overboard positioning information exists in the at least one distress signal, take steps (D1)-(I1). Otherwise, when the intrinsic man overboard positioning information fails to exist in the at least one distress signal, take steps (D2)-(I2).

In view of the above-mentioned, when the intrinsic man overboard positioning information exists in the at least one distress signal, the steps following step (C) comprises: (D1) The onboard processing unit automatically dispatches an unmanned rescue vehicle self-propelled to a falling object by using a personal positioning device. (El) The onboard processing unit sends the classification to the control center. (F1) The control center executes a vehicle takeover command, a notifying rescue team command or a combination thereof. (G1) The control center integrates the remote monitoring images to monitor the falling object in real time and release rescue device by remotely operating or remotely monitoring an unmanned rescue vehicle. (H1) The control center remotely operates a marine vehicle navigating toward the falling object. (I1) The control center directly operates or indirectly operates an assisting device to complete a man recovering process at the approximate location of the falling object.

On the other hand, when the intrinsic man overboard positioning information fails to exist in the at least one distress signal, the steps following step (C) comprises: (D2) The onboard processing unit sends the classification to the control center according to the classification. (E2) The control center executes a vehicle takeover command, a notifying rescue team command or a combination thereof (F2) The onboard processing unit receives an enabling unmanned rescue vehicle command from the control center. (G2) The control center integrates the remote monitoring images to search or direct to the falling object and release rescue device by remotely operating or remotely monitoring an unmanned rescue vehicle. (H2) The control center remotely operates a marine vehicle navigating toward the falling object; and (I2) The control center directly operates or indirectly operates an assisting device to complete a man recovering process at the approximate location of the falling object.

Embodiments of the invention are illustrated by way of example, and not by way of limitation, in the figures of the accompanying drawings in which like reference numerals refer to similar elements.

DETAILED DESCRIPTION OF THE INVENTION

In order to understand the technical features and practical efficacy of the present invention and to implement it in accordance with the contents of the specification, hereinafter, preferred embodiments of the present invention will be described in detail with reference to the accompanying drawings.

Figure 1:
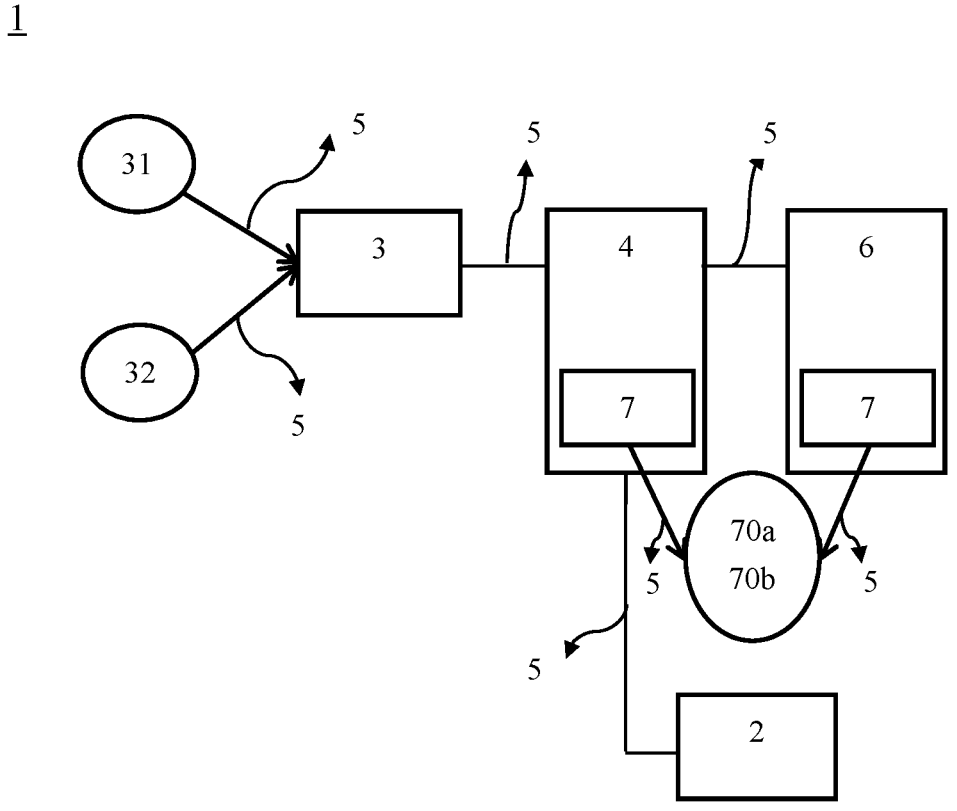
FIG. 1 shows a schematic diagram of the rescue system for man overboard with remote monitoring of the preferred embodiment of the present invention.

The present invention provides a preferred embodiment for executing a rescue system for man overboard with remote monitoring 1. First, please refer to FIG. 1. FIG. 1 is a schematic diagram of a rescue system for man overboard with remote monitoring 1, which is composed of distress signal module 3, onboard processing unit 4, unmanned rescue vehicle 6, control center 2, and collection module 7. The onboard processing unit 4 is installed on the ship and communicates with the distress signal module 3, the unmanned rescue vehicle 6 and the control center 2 through the communication module 5. Further, the control center 2 is wirelessly connected to the onboard processing unit 4 and the collection module 7 through the communication module 5 respectively. Specifically, the "ship" mentioned in the present invention means an autonomous or semi-autonomous driverless ship or low manning ship remotely controlled by the control center 2. In the subsequent embodiments, they are alternatively presented as "mother ship" to indicate said "ship". However, the unmanned rescue vehicle 6 can be provided in any form, to name a few, an unmanned aircraft, an autonomous ship, or a composite type thereof. In this embodiment, the unmanned rescue vehicle 6 is mounted on the ship.

In the present embodiment, the communication module 5 is used by means of regional communication or far/near communication depending on the approximate distance of the falling object from the ship. For example, the means of regional communication can be Lora®, Sigfox®, Automatic Packet Reporting System (APRS), Xbee®; the means of far/near communication can be high frequency radio waves (HF), VHF wireless Electric wave (VHF) or ultra-high frequency radio wave (UHF).

The collection module 7 may be mounted on the autonomous ship or the unmanned rescue vehicle 6, or else, be mounted on both. In the present embodiment, said collection module 7 is mounted at the same time. The number and location of the collection module 7 are determined by the requirements, which is not limited by the present invention. The collection module 7 further includes an image unit, a speech unit, or a combination thereof. For instance, the image unit may be a camera for generating a remote monitoring image 70*a*, and the speech unit may be a recording device for recording voice messages near the monitoring environment. In this embodiment, the purpose of concurrently setting the image unit and the speech unit is to assist the remote monitoring image 70*a* generated by the image unit by means of remote monitoring voice 70*b*, that is, call or broadcast, to communicate more effectively with the controller of the shore control center.

Specifically, when the collection module 7 is mounted on an autonomous ship, the remote monitoring image 70*a* generated by the image unit and the remote monitoring voice 70*b* generated by the speech unit are transmitted to the control center 2 via the communication module 5, such that the control center 2 serves as an interface between people and computers. As such, the controllers of the control center 2 and the crew members of the mother ship are allowed to exchange messages through video and voice simultaneously to constantly monitor whether there are people falling into the water near the autonomous ship. In addition, when the collection module 7 is mounted on the unmanned rescue vehicle 6, the image unit contained therein can also be configured with a voice unit to enable the control center 2 to remotely operate or remotely monitor the unmanned rescue vehicle 6. For instance, the control center 2 remotely operates the rescue device configured thereon for release. On the other hand, as the rescue device is released, the control center 2 remotely monitors the life signs of the falling object near the unmanned rescue vehicle 6, determining whether it is necessary to provide other third-party assistance.

In addition, the distress signal module 3 collects at least one distress signal through communication module 5. The at least one distress signal includes an intrinsic man overboard positioning information 31, an external man overboard positioning information 32, or a combination thereof. The distress signal module 3 collects the intrinsic man overboard positioning information 31 through the personal positioning device worn by the occupants of the autonomous ship, so that when the occupants of the ship have fallen overboard, the unmanned rescue vehicle 6 can be activated and self-propelled immediately, shortening the rescue time and launching the rescue nearby.

Further, the external man overboard positioning information 32 includes an onboard distress signal, a marine distress signal, or a combination thereof. The "onboard distress signal" is derived from the rescue signal received by the mother ship. Specifically, the onboard distress signal includes automatic identification system information, crew member notification information, or a combination thereof. The distress signal module 3 collects the automatic identification system information by an on-board automatic identification system (AIS). The distress signal module 3 collects the crew member notification information from the alert or notification of the on-board crew. In this embodiment, the automatic identification system uses infrared thermal imaging to identify whether there are living bodies in the open water.

On the other hand, the onboard distress signal is detected by at least one emergency beacon, wherein the at least one emergency beacon is an AIS Man Overboard, Personal Locator Beacon (PLB), Emergency Position Indicating Radio Beacon (EPIRB), Emergency Locator Transmitters (ELT) or a combination thereof.

In addition, the present invention further provides a preferred embodiment of a rescue method for man overboard with remote monitoring. Please refer to the flowcharts in FIG. 2 and FIG. 3. The steps include: (A) Remote monitoring images 20 received by a control center 2, along with at least one distress signal collected by a distress signal module 3, are transmitted to an onboard processing unit 4 through a communication module 5. (B) Determining a classification based on the at least one distress signal given by the onboard processing unit 4. (C) Following the classification, the at least one distress signal comprises an intrinsic man overboard positioning information 31, an external man overboard positioning information 32, or a combination thereof.

Figure 2:
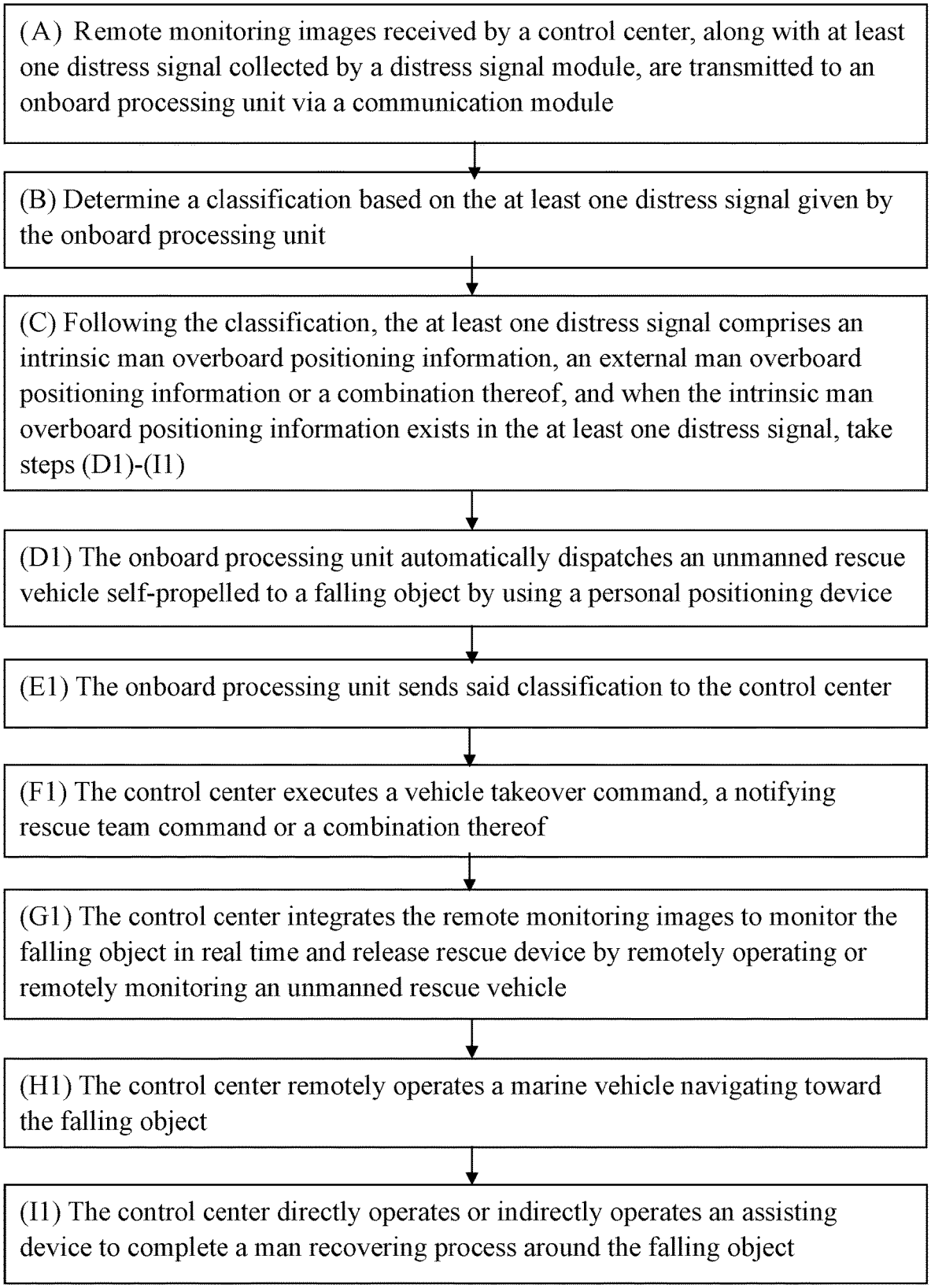
FIG. 2 shows a flow chart of the rescue method for man overboard with remote monitoring of the preferred embodiment of the present invention.

Following the afore-mentioned step (C), please keep referring to the flowchart of FIG. 2. If the intrinsic man overboard positioning information 31 exists in the at least one distress signal, then perform steps (D1)-(I1). (D1) The onboard processing unit automatically dispatches an unmanned rescue vehicle self-propelled to a falling object by using a personal positioning device. (E1) The onboard processing unit sends the classification to the control center. (F1) The control center executes a vehicle takeover command, a notifying rescue team command or a combination thereof. (G1) The control center integrates the remote monitoring images to monitor the falling object in real time and release rescue device by remotely operating or remotely monitoring an unmanned rescue vehicle. (H1) The control center remotely operates a marine vehicle navigating toward the falling object. (I1) The control center directly operates or indirectly operates an assisting device to complete a man recovering process at the approximate location of the falling object.

Figure 3:
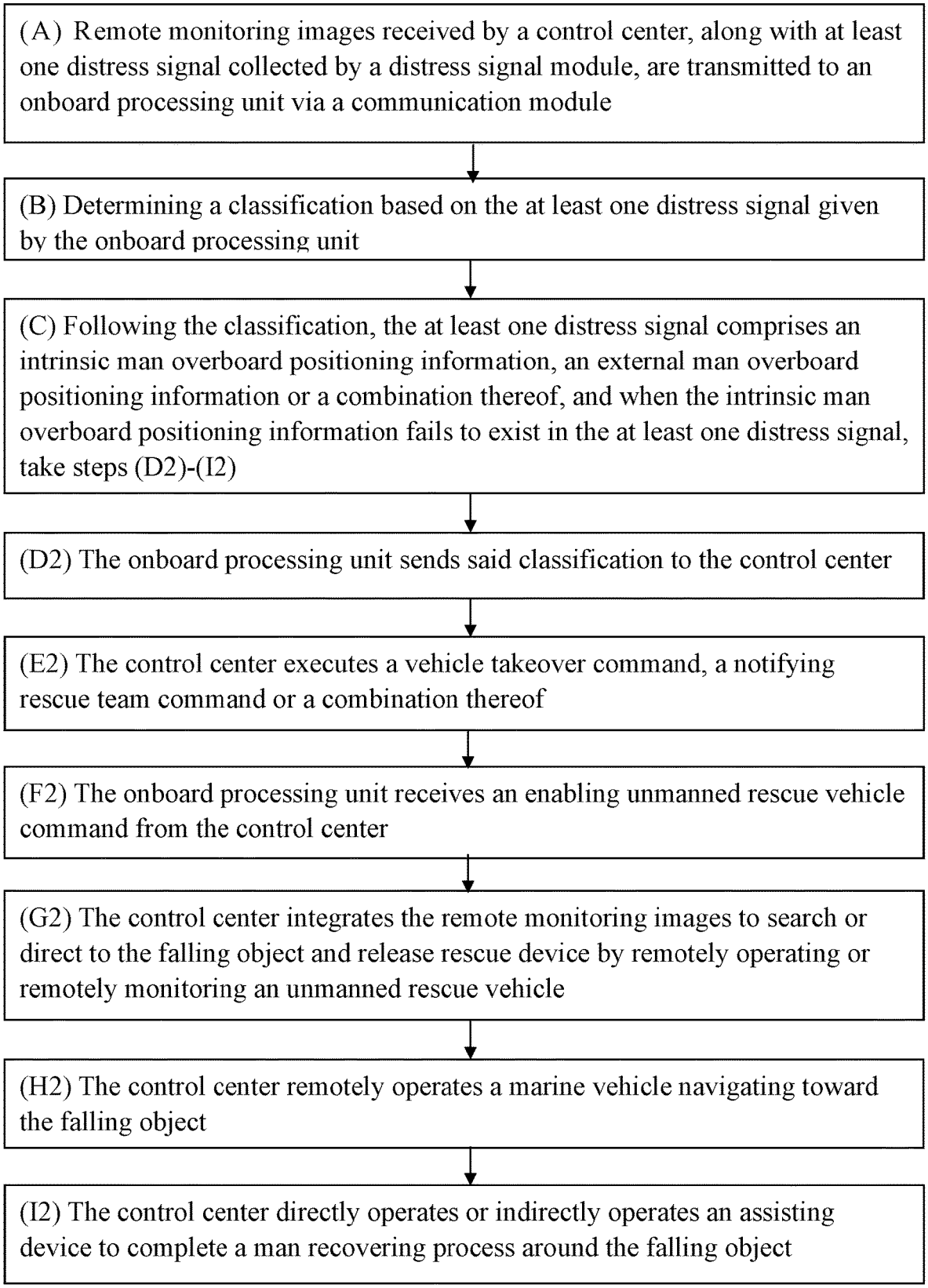
FIG. 3 shows a flow chart of the rescue method for man overboard with remote monitoring of another preferred embodiment of the present invention.

Likewise, following the step (C), please refer to the flowchart in FIG. 3. If the intrinsic man overboard positioning information 31 fails to exist in the at least one distress signal, then perform steps (D2)-(I2). (D2) The onboard processing unit sends the classification to the control center according to the classification. (E2) The control center executes a vehicle takeover command, a notifying rescue team command or a combination thereof. (F2) The onboard processing unit receives an enabling unmanned rescue vehicle command from the control center. (G2) The control center integrates the remote monitoring images to search or direct to the falling object and release rescue device by remotely operating or remotely monitoring an unmanned rescue vehicle. (H2) The control center remotely operates a marine vehicle navigating toward the falling object; and (I2) The control center directly operates or indirectly operates an assisting device to complete a man recovering process at the approximate location of the falling object.

As discussed previously, the rescue method for man overboard with remote monitoring of the present invention is applied to the autonomous or semi-autonomous driverless ships or low manning ships, and the control center 2 herein is the shore control center 2 commonly used for autonomous ships. Said control center 2 accounts for a significant increase in the proportion of tasks in the rescue method of the present invention. Specifically, the control center 2 remote control or remote operation of shipboard equipment, remotely guiding autonomous ship navigation routes, remotely guiding unmanned rescue vehicle 6, and remotely commanding the crew on board, etc.

Please refer to the flowcharts in FIG. 2 and FIG. 3. First, in step (A), the detected distress signal and remote monitoring image 20 are transmitted to the onboard processing unit 4 of the remotely controlled ship directed by the control center 2. In detail, the distress signal may be the intrinsic man overboard positioning information 31 from the individual fallen from the mother ship or may be the external man overboard positioning information 32 from the person fallen overboard off the other vessels. The remote monitoring image 20 comes from a camera configured on the ship or the unmanned rescue vehicle 6 and is sent to the control center 2 via the communication module 5 for remote command.

Furthermore, if there is a person in distress near the unmanned ship remotely directed by the shore control center 2 and given that the person in distress is from the unmanned ship (i.e., mother ship), a rescue system for man overboard with remote monitoring 1 can immediately obtain the intrinsic man overboard positioning information 31 via the personal positioning device worn by crew onboard, which is collected by the distress signal module 3. Upon receiving the intrinsic man overboard positioning information 31, the onboard processing unit 4 automatically dispatches the unmanned rescue vehicle 6 self-propelled to the approximate location of the falling object in the water based on the positioning signal. On the other hand, given that the person in distress comes from other ships or other external sources, the external man overboard positioning information 32, collected by the distress signal module 3 through the communication module 5, may derive from the emergency beacon or otherwise be alerted by the notification of onboard identification system or the crew onboard. Subsequently, the relevant positioning information is transmitted to the onboard processing unit 4 mounted on the unmanned ship.

Following the step (A), the program executed in step (B) intends to classify the distress signals through the onboard processing unit 4, so that the subsequent rescue program is allowed to select appropriate means to complete the rescue as soon as possible. In this embodiment, in step (C), the distress signals are further classified into the following: intrinsic man overboard positioning information 31, external man overboard positioning information 32, or the combination thereof. Upon the distress signal collected by the onboard processing unit 4, if the distress signal is classified and processed by the onboard processing unit 4 and contains the intrinsic man overboard positioning information 31, then continue to perform steps (D1)-(I1); otherwise, if the distress signal does not include the intrinsic man overboard positioning information 31 after the distress signal is classified and processed by the onboard processing unit 4, that is, solely the external man overboard positioning information 32 (the person falling in the water is an external person) is included, and then continue to perform steps (D2)-(I2) in the following process. Since some of the steps contained in the above two sets of subsequent steps are substantially the same, in order to obtain the reduction in the length of the following description, the number of steps comprising the same technical feature will be supplemented with parentheses.

In other words, in the event that the person overboard is from a crew member of the mother ship, after the onboard processing unit 4 completes the distress signal classification process, firstly perform the step (D1): onboard processing unit 4 immediately and automatically dispatches the unmanned rescue vehicle 6 navigating to the falling target based on the intrinsic man overboard positioning information 31 of the personal positioning device. That is to say, the unmanned rescue vehicle 6 is connected to the onboard processing unit 4 from time to time and autonomously navigates to the location of the person falling into the water according to the positioning information, and then executes step (E1) (replaced with step (D2) if the person falling into the water is an external person). In step (E1), the onboard processing unit 4 sends the result of said classification to the control center 2. If the individual fallen overboard is an external person, the step (D2) will be executed directly after the step (C) is completed.

In this embodiment, when the person overboard is an onboard crew, the onboard processing unit 4 have received the intrinsic man overboard positioning information 31 of the personal positioning device from the distress signal module 3. Furthermore, the position of the unmanned ship has acquired by the control center 2 remotely. Simultaneously, the control center 2 also receives the intrinsic man overboard positioning information 31 sent by the onboard processing unit 4. In this regard, once someone falls overboard, the distance between the falling object and the ship is still close. As a result, since the rescue system for man overboard with remote monitoring 1 of the present invention has pinpointed the locations of the ship as well as the man overboard, the unmanned rescue vehicle 6 dispatched from the mother ship obtains the more precise positions compared with the other unmanned rescue vehicles remotely directed from the shore in the general rescue process. Therefore, with the above-mentioned technical advantages, the optimal rescue path for the unmanned rescue vehicle 6 can be quickly planned and the overall rescue time can be shortened.

After the shore control center 2 receives the classification of the distress signal through the onboard processing unit 4, initiating step (F1) (if the person falling into the water is an external person, then step (E2)): the control center 2 executes a vehicle takeover command, a notifying rescue team command or both of the instructions. The execution of the ship's takeover command is to control the ship remotely, and the control center personnel directly issue the command to confirm the ship's positioning remotely, and the position relationship between the unmanned rescue vehicle 6 and the ship can be acquired through some regional position system or in combination of inertial navigation system and other technologies to accurately obtain relative position information. For instance, in terms of the underwater positioning system, the short baseline positioning system or the long baseline positioning system is generally used. In terms of the positioning above the sea level, the differential GPS is mostly used. On the other hand, carrying out the notifying rescue team command means to win the support from an external third-party rescue team by sending an alert for help, which provides an alternative protection for the entire rescue process.

When the control center 2 completes the aforementioned instructions for taking over the ship and notifying the rescue team, given that the distress signal does not include the intrinsic man overboard positioning information 31, that is, the individual overboard is an external person, then step (F2) is executed: the onboard processing unit 4 receives the enabling unmanned rescue vehicle command from the control center 2 (conversely, if the distress signal includes the intrinsic man overboard positioning information 31, that is, the person fallen overboard is a crew member, this step is unnecessary and thus omitted considering that the unmanned rescue vehicle 6 has been automatically dispatched in step (D1)). In other words, the shore control center 2 (SCC) has been tracking the locations of the unmanned ship and the unmanned rescue vehicle 6, and then the unmanned rescue vehicle 6 has been launched from the ship. The foregoing process finished releasing the unmanned rescue vehicle 6 from the unmanned ship. To be precise, the unmanned rescue vehicle 6 may be released from the portion of the ship that is the position of the hull near the overboard individual.

After completing the previous preparatory steps, in the condition that the person overboard is a member of the ship, step (G1) is carried out immediately in view that the unmanned rescue vehicle 6 has automatically arrived at the person overboard at the first time in the previously mentioned step (D1). In step (G1), the control center 2 integrates the remote monitoring images 70*a* to monitor the falling object in real time and release rescue device by remotely operating or remotely monitoring an unmanned rescue vehicle 6. In other words, in step (G1), the control center 2 uses the remote monitoring image 70*a* and remote monitoring voice 70*b* generated by the collection module 7 to remotely control the rescue device or remotely monitor the condition of the falling object near the unmanned rescue vehicle 6. Specifically, "remote operation" mode is selected for the controller of the control center 2 to remotely operate the rescue device for releasing. Alternatively, "remote monitoring" mode is selected for the unmanned rescue vehicle 6 to release the rescue device actively and automatically without the command given from the control center 2. The unmanned rescue vehicle 6 gives instructions to drop rescue device to the overboard individual and monitors the life signs of the overboard personnel through the control center 2 during this rescue process.

On the other hand, if the person falling overboard is an external person, perform step (G2). The control center 2 combines the remote monitoring image 70*a* and remote monitoring voice 70*b* to remotely operate or remotely monitor the unmanned rescue vehicle 6 to find or directly reach the falling target. That is, the control center 2 actively operate or passively monitor the self-propelled path of the unmanned rescue vehicle 6. Furthermore, once the unmanned rescue vehicle 6 arrives at the individual who fell into the water, as previously elaborated, the control center 2 releases the rescue device installed on the unmanned rescue vehicle 6 by implementing the "remote operation" mode or the "remote monitoring" mode through the remote monitoring image 70*a* and remote monitoring voice 70*b* generated by the collection module 7 on the unmanned rescue vehicle 6. The aim of the previous discussed is to ensure that the rescue device can be quickly launched and within the arm's reach of the man overboard under the operation or monitoring of the shore control center 2 (SCC) upon the individual falling overboard.

In view of the above, the purpose of the unmanned rescue vehicle 6 launching before the unmanned ship to the overboard target is to save the time, so that the overboard individual will not be in a life-threatening situation due to the delay of time. In the process as to the unmanned rescue vehicle 6 navigating to the falling object, step (H1) can be performed simultaneously or afterwards (if the person who fell into the water is an external person, then step (H2)), so that the control center 2 can remotely operate a marine vehicle navigating toward the falling object. Specifically, the "ship" is an unmanned ship controlled by control center 2, and the "falling object" can be a passenger on the unmanned ship, or a person in distress who just falls near the unmanned ship. The number of the "falling object" can be one or more. All the "falling objects" situated near the unmanned ship are included in this invention provided that the victims can be detected by the rescue system for man overboard with remote monitoring 1 in the present invention. In this step, if there is more than one falling object, the control center 2 controller can plan the self-propelled path according to the distance between the multiple falling targets and the ship, and then control the unmanned ship to approach the person who is still on the water, monitoring the positional relationship between the unmanned rescue vehicle 6 and the unmanned ship at all times in order to approach the individual to be rescued accurately and safely.

When the controller of the shore control center 2 (SCC) makes the unmanned ship approaching the person who fell into the water, proceed to step (I1) (if the person who fell into the water is an external person, then step (I2)), moving the man overboard onto the ship. In said rescue process, the control center 2 directly operates or indirectly operates an assisting device to complete a man recovering process around the falling object. For example, the so-called "indirect operation" means that other passengers onboard can help rescue people who fall into the water or cooperate with the ship's assisting devices to retrieve the people under the guidance of the shore control center 2. The " assisting device" may be a rescue rod/hook, rescue strop, rescue basket, rescue davit, Jason Cradle®, etc. The "man recovering process" refers to the operation process of moving the individual to be rescued from the unmanned rescue vehicle 6 and placing them on the unmanned ship (i.e., mother ship). In addition to the "direct operation" of the assisting device by the passengers of the mother ship, provided that there is no manning on the ship, alternatively, the so-called "direct operation" is to pull the individual back to the ship using the multi-degree-of-freedom mechanical device (such as a robotic arm) configured onboard by the remote operation of the control center 2. In summary, by using assisting devices as the means of moving people to be rescued onto the ship, the entire rescue process is monitored and supervised by the shore control center 2 through videos and broadcast.

In summary, the purpose of the present invention is to provide a rescue method for man overboard with remote monitoring, especially using a rescue system for man overboard with remote monitoring 1 which is consisted of the shore control center 2 remotely guiding shipboard assisting device and the unmanned rescue vehicle 6. The distinct difference with the prior arts lies in that the integration of the shore control center 2 (SCC) required for the operation of unmanned ships with the dispatch of rescue vehicles brings about a comprehensive rescue system.

The technical effect of the present invention is that the shore control center 2 (SCC) can acquire the location of the seafarer of the mother ship who has fallen into the water upon the overboard incident occurring and can accurately acquire the relative position between the unmanned rescue vehicle 6 and the mother ship, which is remotely controlled by the shore control center 2 (SCC) operating the entire rescue process. The shore control center 2 constantly monitors the situation of people overboard through the unmanned rescue vehicle 6 and casts the rescue devices thereto. Furthermore, in the case of unmanned or low-level personnel on an unmanned ship, the shore control center 2 (SCC) can be used to control the ship's multi-degree-of-freedom rescue device (such as a robotic arm) or remotely guides the unmanned rescue vehicle 6 with assisting devices to retrieve the overboard person from the water. In this regard, the manpower problem of the unmanned ship is solved, and the efficiency of the entire rescue process is improved. On the other hand, for other external persons in distress, the control center 2 remotely control the ship and combine the previous rescue procedures to rescue the persons in distress as near as possible, whether they are discovered by the mother ship itself or upon the request by a third party.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

What is claimed is:

1. A rescue method for man overboard with remote monitoring, implemented by a rescue system for man overboard with remote monitoring, wherein the rescue system for man overboard with remote monitoring comprising: an onboard processing unit, disposed on a marine vehicle; a communication module; a distress signal module, wirelessly connected with the onboard processing unit via the communication module; an unmanned rescue vehicle, wirelessly connected with the onboard processing unit via the communication module;

a collection module, disposed on the marine vehicle, the unmanned rescue vehicle or a combination thereof; and a control center, wirelessly connected with the onboard processing unit and the collection module via the communication module;

wherein the rescue method comprising:

(A) remote monitoring images received by the control center, along with at least one distress signal collected by the distress signal module, transmitted to the onboard processing unit via the communication module;

(B) the distress signal module collecting an intrinsic man overboard positioning information through the personal positioning device worn by the occupants of the autonomous ship, and determining a classification based on the at least one distress signal given by the onboard processing unit; and (C) following the classification, the at least one distress signal comprising the intrinsic man overboard positioning information, an external man overboard positioning information or a combination thereof; wherein the external man overboard positioning information including an onboard distress signal, a marine distress signal, or a combination thereof;

wherein the intrinsic man overboard positioning information exists in the at least one distress signal, take steps (D1)-(I1); wherein the intrinsic man overboard positioning information fails to exist in the at least one distress signal, take steps (D2)-(I2);

wherein the steps following steps (D1)-(I1) comprises:

(D1) the onboard processing unit automatically dispatching an unmanned rescue vehicle self-propelled to a falling object by using a personal positioning device;

(E1) the onboard processing unit sending said classification to the control center;

(F1) the control center executing a vehicle takeover command, a notifying rescue team command or a combination thereof;

(G1) the control center integrating the remote monitoring images to monitor the falling object in real time and release rescue device by remotely operating or remotely monitoring an unmanned rescue vehicle;

(H1) the control center remotely operating a marine vehicle navigating toward the falling object; and (I1) the control center directly operating or indirectly operating an assisting device to complete a man recovering process around the falling object wherein the steps following steps (D2)-(I2) comprises:

(D2) the onboard processing unit sending said classification to the control center;

(E2) the control center executing a vehicle takeover command, a notifying rescue team command or a combination thereof;

(F2) the onboard processing unit receiving an enabling unmanned rescue vehicle command from the control center;

(G2) the control center integrating the remote monitoring images to search or direct to the falling object and release rescue device by remotely operating or remotely monitoring an unmanned rescue vehicle;

(H2) the control center remotely operating a marine vehicle navigating toward the falling object; and (I2) the control center directly operating or indirectly operating an assisting device to complete a man recovering process around the falling object.

2. The rescue method for man overboard with remote monitoring as claimed in claim 1, wherein the onboard distress signal comprises an automatic identification system information, a crew member notification information or a combination thereof.

3. The rescue method for man overboard with remote monitoring as claimed in claim 1, wherein the marine distress signal is detected by at least one emergency beacon, and wherein the at least one emergency beacon is an AIS Man Overboard (AIS MOB), a Personal Locator Beacon (PLB), an Emergency Position Indicating Radio Beacon (EPIRB), an Emergency Locator Transmitters (ELT) or a combination thereof.

* * * * *